US005387284A

United States Patent [19]

Moody

[11] Patent Number: 5,387,284

[45] Date of Patent: Feb. 7, 1995

[54] APPARATUS AND METHOD FOR FORMING CORELESS PAPER ROLL PRODUCTS

[75] Inventor: John R. Moody, Antioch, Calif.

[73] Assignee: James River Paper Company, Inc., Richmond, Va.

[21] Appl. No.: 206,644

[22] Filed: Mar. 7, 1994

[51] Int. Cl.[6] ..... B05C 1/00

[52] U.S. Cl. ..... 118/220; 118/221; 118/225; 118/235; 118/264; 242/525.7; 242/542.2

[58] Field of Search ..... 118/220, 221, 225, 235, 118/244, 252, 264, 268; 427/179, 285, 288, 289, 429; 242/56.2, 66

[56] References Cited

U.S. PATENT DOCUMENTS

| | | | |
|---|---|---|---|
| 309,332 | 12/1884 | Clarke | 242/68.5 |
| 610,339 | 9/1898 | Atherton | 400/615.2 |
| 1,634,258 | 7/1927 | Halpin | 118/264 |
| 1,880,448 | 10/1932 | Hickman | 430/501 |
| 1,882,012 | 10/1932 | Hires | 242/68.5 |
| 1,930,250 | 10/1933 | Mulligan | 242/68.5 |
| 2,610,934 | 9/1952 | Steele | 118/221 |
| 3,078,821 | 2/1963 | McEwen | 118/220 |
| 3,372,673 | 3/1968 | Di Mattia | 118/221 |
| 3,745,972 | 7/1973 | Thettu | 118/268 |
| 3,823,887 | 7/1974 | Gerstein | 242/56.2 |
| 3,853,279 | 12/1974 | Gerstein | 242/56.2 |
| 3,856,226 | 12/1974 | Dowd, Jr. | 242/56 R |
| 4,173,313 | 11/1979 | Rogers | 242/56.2 |
| 4,201,352 | 5/1980 | Madachy | 242/56.2 |
| 4,487,378 | 12/1984 | Kobayashi | 242/68 |
| 4,783,015 | 11/1988 | Shimizu | 242/1 |
| 4,895,315 | 1/1990 | Salmela et al. | 242/66 |
| 4,908,670 | 3/1990 | Ndebi | 118/264 |
| 4,962,897 | 10/1990 | Bradley | 242/66 |
| 5,271,137 | 12/1993 | Schutz | 29/400.1 |
| 5,271,575 | 12/1993 | Weinert | 242/67.1 R |
| 5,281,386 | 1/1994 | Weinert | 264/512 |

FOREIGN PATENT DOCUMENTS

| | | | |
|---|---|---|---|
| 1036065 | 8/1978 | Canada | 242/56.2 |
| 0895535 | 1/1982 | U.S.S.R. | 118/268 |

*Primary Examiner*—W. Gary Jones
*Assistant Examiner*—Laura E. Edwards
*Attorney, Agent, or Firm*—Thomas R. Lampe

[57] ABSTRACT

An apparatus and a method for forming coreless paper roll products are disclosed. Coreless paper roll products are formed by slitting a paper web to form web segments having side edges. The web segments are then wound about an elongated winder shaft. During winding of the paper web, liquid is applied to the web segments only at the side edges thereof while maintaining the web segments free of liquid between the side edges. When the rolls are formed and stripped from the winder shaft, the openings located at the ends of the roll at the roll central aperture will be well defined and allow ready insertion of a dispenser spindle. All the material of the roll can then be dispensed.

6 Claims, 2 Drawing Sheets

APPARATUS AND METHOD FOR FORMING CORELESS PAPER ROLL PRODUCTS

TECHNICAL FIELD

The invention has application to the formation of paper rolls. More particularly, the invention relates to an apparatus and a method for forming coreless tissue rolls.

BACKGROUND ART

It is well known to form coreless paper roll products such as rolls of toilet tissue on winder mandrels or shafts. Arrangements of this type are disclosed, for example, in U.S. Pat. No. 3,853,279, issued Dec. 10, 1974, U.S. Pat. No. 3,856,226, issued Dec. 24, 1974, U.S. Pat. No. 5,271,137, issued Dec. 21, 1993, and U.S. Pat. No. 5,271,575, also issued on Dec. 21, 1993.

Coreless tissue rolls are finding increased acceptance in the marketplace. By not employing a conventional roll core of paperboard or the like, more tissue can be incorporated in the roll for any given diameter. Furthermore, there is essentially no product waste as compared to conventional arrangements wherein the core of paperboard or other material must be discarded after use.

A problem does present itself with regard to coreless tissue rolls in that the aperture or hole passing through the center of the roll can lose definition, making it difficult, if not impossible, for a dispenser spindle to be inserted into a roll end.

As is disclosed in detail below, the present invention solves this problem by wetting the coreless paper roll at the ends thereof, and only at the ends thereof, during manufacture, i.e. while the coreless paper roll product is being formed on a rotating winder shaft. When the roll product is removed from the shaft, the ends will generally retain the shape of the winder shaft and not collapse, thus allowing ready insertion of a dispenser spindle to allow use by a consumer.

It is known in the prior art to form the central core of a toilet paper roll by winding the advancing or lead end of a paper web between rolls having corrugated peripheries and at the same time applying glue or paste to the paper web so that the web is initially wound upon a corrugated mandrel and pressed into a multi-ply corrugated roll upon which the web may be further wound without the application of glue, the result being a finished toilet roll package having a corrugated roll.

U.S. Pat. No. 1,882,012, issued Oct. 11, 1932, discloses the system just described. The problem with this prior art approach is that one still can not dispense and utilize all of the paper. The core still must be discarded, resulting in material waste.

U.S. Pat. No. 4,487,378, issued Dec. 11, 1984, discloses a coreless toilet paper roll having a center hole which is formed by winding toilet paper on a winding shaft having a polygonal or gear-shaped cross-section and then extracting the polygonal or gear-shaped winding shaft from the roll. The special shafts employed when practicing the method of this invention are quite expensive as compared to round mandrels or winding shafts.

In contrast to the approach disclosed in U.S. Pat. No. 5,271,575, the present invention provides for a stable entry hole in a coreless paper roll without the necessity of employing an expensive specially-shaped winding shaft. The present approach utilizes a round winder shaft which is inexpensive, readily available, and can be utilized with commercially available re-winder equipment.

U.S. Pat. No. 4,783,015, issued Nov. 8, 1988, discloses a toilet paper roll which is devoid of a paperboard core and has a two-layered structure comprising a hard core layer portion formed by tightly rolling up toilet paper on a temporary take-up core which is eventually removed and an outer layer portion formed continuous to the core layer portion by rolling up the toilet paper less tightly than the core layer portion. The approach requires specialized, expensive equipment and hard winding of the inner layers of the roll can not only diminish the softness and other desirable physical characteristics thereof but also actually promote collapse of the center hole due to the tight winding of the inner convolutions. Furthermore, tight winding can make the roll inapplicable for use with certain types of spindles, particularly spindles having a cross-section greater in magnitude than that of the central roll aperture.

As noted above, the present invention incorporates the step of applying a liquid only at the ends of a roll during formation thereof. It is known in the prior art to apply a liquid between a mandrel and the leading end of a tissue web to be wound thereon to secure the end of the tissue to the mandrel. Such an arrangement is illustrated in U.S. Pat. No. 3,823,887, issued Jul. 16, 1974. In this prior art arrangement, the tissue web end and mandrel are wetted along the entire length thereof. Although not described with clarity in the patent, wetting appears to be accomplished by means of a wet sponge 74 impressed onto the mandrel and leading end of the tissue web along the full width of the web. Since the completed roll product is wetted in the interior thereof along the full roll length, application of liquid can result in bonding of a significant number of convolutions of the roll and thus make such convolutions unavailable for use.

Another patent of interest is U.S. Pat. No. 5,281,386, issued Jan. 25, 1994, wherein a probe element is inserted in a coreless paper roll end and liquid inserted into the roll end through the probe to change hole shape after roll formation.

Other patents of some relevance to the present invention of which applicant is aware are the following: U.S. Pat. No. 1,930,250, issued Oct. 10, 1933, U.S. Pat. No. 4,895,315, issued Jan. 23, 1990, U.S. Pat. No. 1,880,448, issued Oct. 4, 1932, U.S. Pat. No. 610,339, issued Sep. 6, 1898, and U.S. Pat. No. 309,332, issued Dec. 16, 1884.

DISCLOSURE OF INVENTION

The present invention relates to a system of forming a coreless paper roll product, such as a toilet tissue roll having a center aperture which has well defined openings at the ends of the completed roll product, enabling the openings to readily receive a dispenser support spindle. The system involves the application of a liquid only at the side edges of the tissue web being wound, thus enabling a consumer to utilize all of the wound tissue web with little or no waste.

The method of forming coreless paper roll products according to the present invention includes the step of transporting a paper web toward an elongated winder shaft having an outer peripheral surface, the paper web having a plurality of parallel slits formed therein defining web segments. Each web segment has side edges defining a predetermined web segment width.

Contact is established between the paper web and the outer peripheral surface of the elongated winder shaft with the slits located at predetermined spaced locations along the elongated winder shaft.

After the step of establishing contact between the paper web and the outer peripheral surface of the elongated winder shaft, the elongated winder shaft is rotated to wind the paper web about the outer peripheral surface of the elongated winder shaft with the side edges of adjacent web segments positioned immediately adjacent to one another and located at one of the predetermined spaced locations to form a plurality of coreless paper roll products aligned with each other, extending axially along the elongated winder shaft, and having coreless paper roll product ends at the spaced locations.

During winding of the paper web about the elongated winder shaft, liquid is applied to the web segments only at the side edges thereof while maintaining the web segments substantially free of liquid between the side edges thereof.

Rotation of the elongated winder shaft is stopped after the coreless paper roll products have attained a predetermined diameter.

Liquid application to the web segment side edges is terminated during winding of the paper web and prior to the coreless paper roll products attaining the predetermined diameter, so that only the inner convolutions of the coreless paper roll products are moistened at the coreless paper roll product ends.

The final step of the method comprises removing the coreless paper roll products from the elongated winder shaft.

The apparatus of the present system includes a rotatable, elongated winder shaft having an outer peripheral surface.

Web transport means is provided for transporting a paper web to the elongated winder shaft.

Another structural element is slitter means for slitting the paper web to form web segments having side edges defining a predetermined web segment width.

Winder shaft rotating means is provided for rotating the elongated winder shaft to wind the slit paper web about the outer peripheral surface thereof with the side edges of adjacent web segments positioned immediately adjacent to one another and located at predetermined spaced locations along the elongated winder shaft to form a plurality of coreless paper roll products aligned with each other, extending axially along the elongated winder shaft, and having coreless paper roll product ends at said predetermined fixed locations.

Liquid applicator means applies liquid to the web segments only at the side edges during winding of the web segments about the elongated winder shaft.

Other features, advantages, and objects of the present invention will become apparent with reference to the following description and accompanying drawings.

MODES FOR CARRYING OUT THE INVENTION

Figure 1:
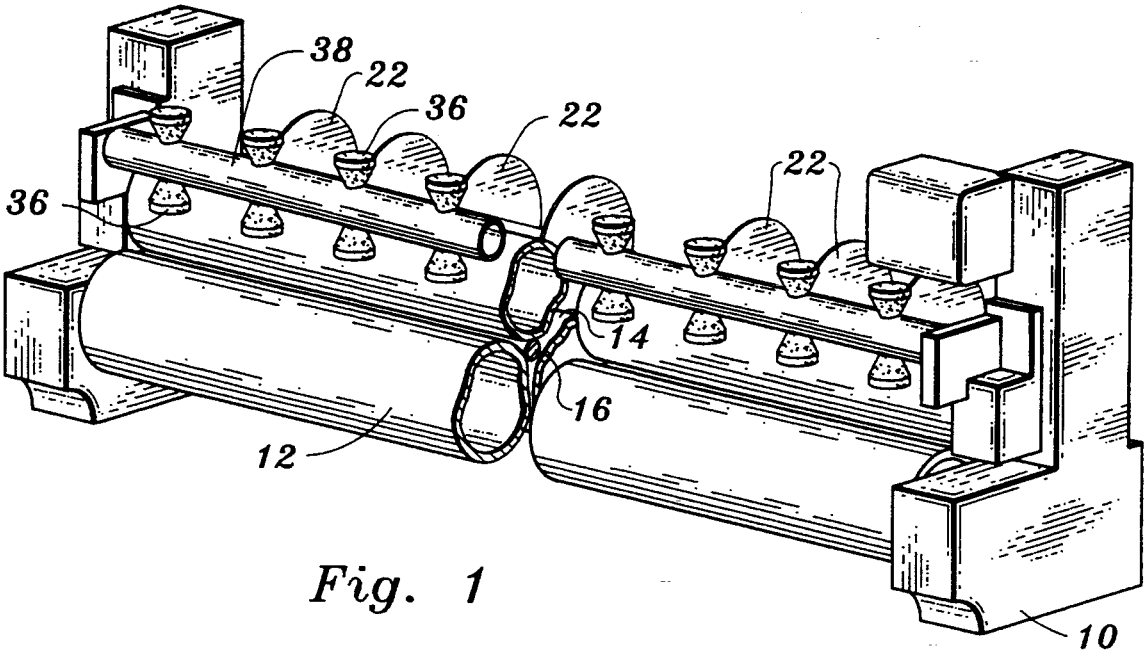
FIG. 1 is a perspective view of apparatus constructed in accordance with the teachings of the present invention, with certain segments thereof illustrated in cross-section.
Figure 2:
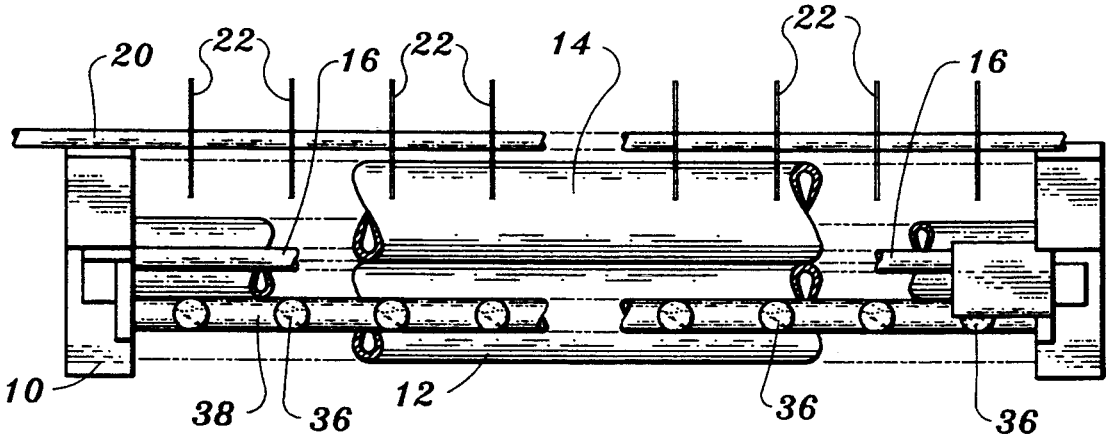
FIG. 2 is a top plan view of the apparatus with certain portions thereof illustrated in cross-section.
Figure 3:
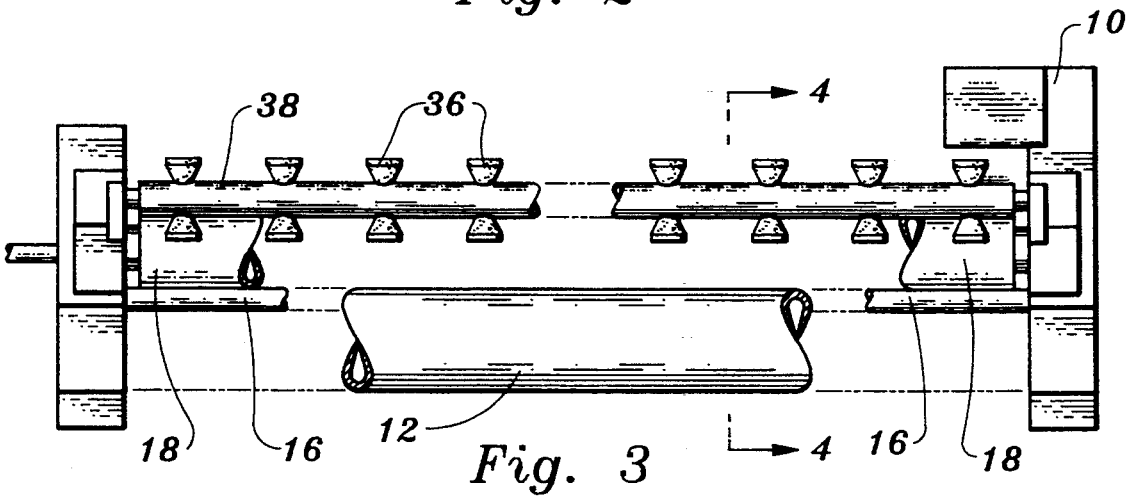
FIG. 3 is a front elevational view of the apparatus, with certain portions thereof broken away and illustrated in cross-section.

Referring to FIGS. 1–4, 6 and 7, apparatus for carrying out the teachings of the present invention in essence comprises a conventional slitter/winder machine which has been modified to perform the desired operations of the invention. The apparatus includes a frame 10 supporting a pair of trunnion rolls 12, 14 which are rotatably driven by suitable conventional drive structure in the winder/slitter apparatus in the directions of the arrows illustrated in FIG. 4.

A conventional free floating mandrel or winder shaft 16 having a smooth round outer peripheral surface rests upon trunnion rolls 12, 14 and is in frictional engagement with the outer surfaces of the trunnion rolls. The winder shaft is not mounted at its ends and is rotated when the trunnion rolls are rotated simply due to the frictional engagement between the winder shaft and trunnion rolls.

A rider roll 18 floats on the winder shaft and above the trunnion rolls, the rider roll always bearing downwardly against the winder shaft under the influence of gravity. If desired, a mechanical form of biasing means (not shown) may be utilized to augment the downward bias imparted to the winder shaft by the rider roll.

Disposed adjacent to rolls 12, 14 and 18 is a rotatable blade support shaft 20 having a plurality of web slitter blades 22 affixed thereto and rotatable therewith. Slitter blades 22 are in the path of movement of a paper web 24 (FIGS. 6 and 7) transported toward elongated winder shaft 16. The rotating slitter blades 22 slit the paper web 24 creating slits 26 in the web and forming web segments 28. This slitting or cutting operation takes place as the web is being wrapped about the outer peripheral surface of rotating elongated winder shaft 16. The slits 26 are located at predetermined spaced locations along the elongated winder shaft a distance equal to the width of the web segments, such width, of course, being defined by the side edges 30 of the web segments.

Figure 6:
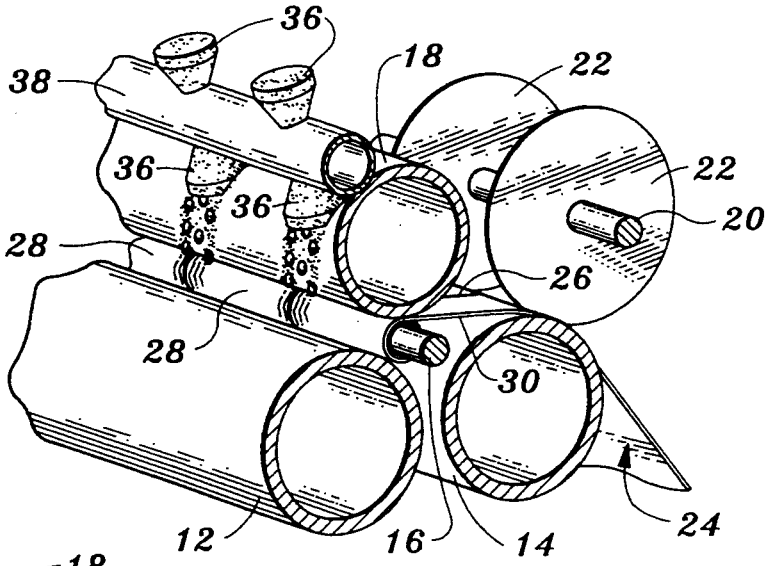
FIGS. 6 and 7 are perspective views in partial cross-section showing a segment of the embodiment of FIG. 1 illustrating sequential stages in the operation thereof.

After contact has been established between the paper web and the outer peripheral surface of the elongated winder shaft 16, continued rotation of the elongated winder shaft will, as depicted in FIG. 6, wind the paper web about the outer peripheral surface of the elongated winder shaft with the side edges of adjacent web segments 28 positioned immediately adjacent to one another and located at one of the predetermined spaced locations along the shaft to form a plurality of coreless paper roll products aligned with each other, extending axially along the elongated winder shaft, and having coreless paper roll product ends at the spaced locations, the ends being defined by the convolution edges.

During winding of the paper web about the elongated winder shaft, liquid is applied to the web segments only at the side edges thereof while maintaining the web segments substantially free of liquid between the side edges. This is shown in FIG. 6. The liquid may, for example, suitably be merely water. The objective is to moisten the edges of the rolls at the inner convolutions thereof at the roll ends so that the tissue or other paper comprising the web will mold itself to the shape of the shaft at the roll ends. That is, the water will cause a breakdown in the fiber bonds of the edges where moistened, it being understood that subsequent drying will re-establish the fiber bonds and maintain a configuration at the openings of the central aperture passing through the roll products to generally retain the round configuration of the shaft. This will enable ready entry of a dispenser spindle into the roll ends after manufacture thereof.

In the arrangement of FIGS. 1–4, 6 and 7, water or other liquid is applied by the rider roll 18, the rider roll having the liquid applied thereto by liquid applicator means in the form of sponges 36 which project from a liquid supply reservoir in the form of a hollow tube 38. It is to be understood that the hollow tube has spaced apertures formed along the periphery thereof which provide communication between the sponges and the interior of the hollow tube. The hollow tube 38 is connected to a suitable source (not shown) of pressurized water or other liquid to maintain liquid supply to the sponges.

Figure 4:
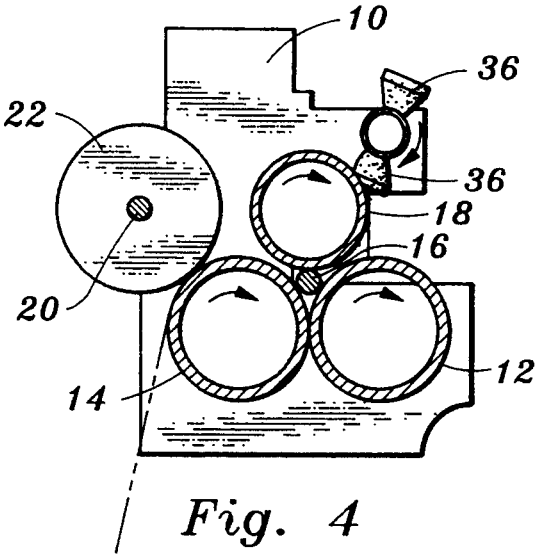
FIG. 4 is a cross-sectional view taken along the line 4—4 in FIG. 3.
Figure 7:
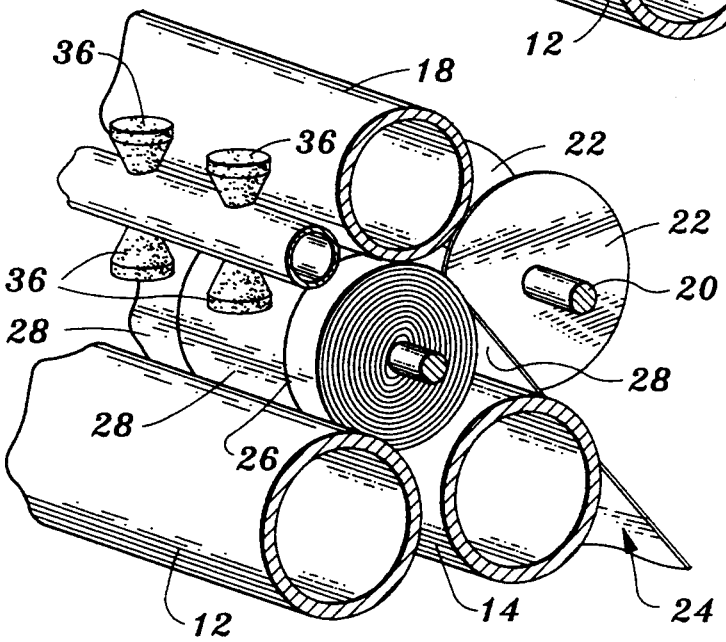

The tube 38 is rotatably mounted relative to framework 10 so that the sponges 36 can be brought into engagement with the rider roll or out of engagement with the rider roll as desired. FIGS. 4 and 6 show the sponges in engagement and FIG. 7 shows them out of engagement. In the arrangement illustrated, two diametrically opposed rows of sponges 36 are shown which may be used alternatively. Such an arrangement may, for example, allow ready replacement of sponges on one side of the tube without interrupting the operation of the device. Also, employing two sets of sponges allows one set to re-moisten while the other dispenses liquid. Any suitable means may be employed to mount and rotate the tube and bring the sponges into and out of engagement with the rider roll. This may be accomplished automatically or even manually.

Of course, the sponges 36 must be in alignment with the location of the slits formed in the paper web 24 so that only the side edges of the web segments are wetted.

After a desired number of convolutions have been formed, the application of liquid to the web segment side edges is terminated. Winding of the paper web continues, as shown in FIG. 7, until the coreless paper roll products attain the diameter desired. That is, only the inner convolutions of the coreless paper roll products are moistened at the coreless paper roll product ends. Such an approach will enable a consumer to completely deplete the roll during use. Thus, there is no paper waste.

After the coreless paper roll products have been completely formed, they are stripped from the winder shaft or mandrel 16 in the usual fashion. The roll products after removal incorporate well defined openings at the ends to facilitate use of the roll products.

Figure 5:
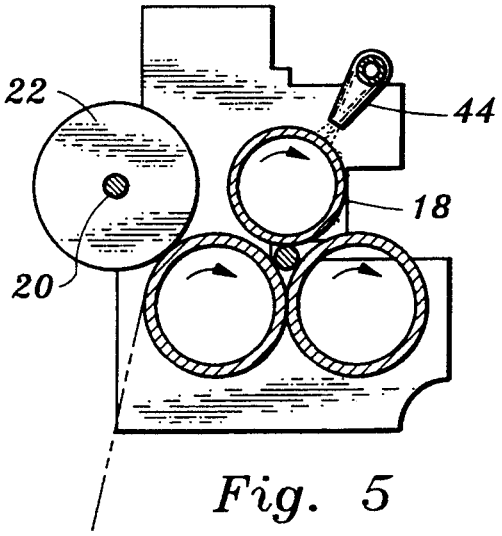
FIG. 5 is a view similar to FIG. 4 but illustrating an alternative embodiment of the present invention.

FIG. 5 shows an alternative embodiment of the apparatus wherein a series of spray nozzles 44 (only one of which is shown in FIG. 5) apply liquid to the rider roll 18 which in turn applies the liquid to the web segments during winding thereof.

I claim:

1. Apparatus for forming coreless paper roll products, said apparatus comprising, in combination:

a rotatable, elongated winder shaft having an outer peripheral surface of a predetermined configuration;

web transport means for transporting a paper web to said elongated winder shaft for winding about said elongated winder shaft upon rotation of said elongated winder shaft;

slitter means adjacent to said elongated winder shaft for slitting said paper web during transport of said paper web to said elongated winder shaft to form web segments having side edges defining a predetermined web segment width;

winder shaft rotating means for rotating said elongated winder shaft to wind the slit paper web about the outer peripheral surface of the elongated winder shaft with the side edges of adjacent web segments positioned immediately adjacent to one another and located at predetermined spaced locations along said elongated winder shaft to form a plurality of coreless paper roll products aligned with each other, extending axially along said elongated winder shaft, and having coreless paper roll product ends at said predetermined spaced locations;

a rider roll forming a nip with the elongated winder shaft bearing against said web segments and cooperable with said elongated winder shaft to exert opposed compressive forces on said web segments as the web segments are wound about said elongated winder shaft; and liquid applicator means located adjacent to the elongated winder shaft for applying liquid to the web segments only at the side edges thereof during winding of said web segments about said elongated winder shaft and while the web segments are on the elongated winder shaft to moisten the side edges only of web segments on the elongated winder shaft to facilitate molding of the web segment side edges to the predetermined configuration of the elongated winder shaft outer peripheral surface under the opposed compressive forces exerted by said elongated winder shaft and said rider roll.

2. The apparatus according to claim 1 wherein said liquid applicator means includes a plurality of spaced applicator elements aligned with said predetermined spaced locations.

3. The apparatus according to claim 2 wherein said applicator elements comprise a plurality of sponges.

4. The apparatus according to claim 1 wherein said liquid applicator means includes liquid spray nozzle means.

5. The apparatus according to claim 1 wherein said slitter means comprises a plurality of slitter blades located adjacent to and spaced along said elongated winder shaft.

6. The apparatus according to claim 5 wherein said slitter blades are aligned with said predetermined spaced locations along said elongated winder shaft.

* * * * *